United States Patent [19]

Musgrave

[11] 4,089,266

[45] * May 16, 1978

[54] EXPLOSIVE BARRIER WIRE

[76] Inventor: Daniel D. Musgrave, 8201 Caraway St., Cabin John, Md. 20731

[ * ] Notice: The portion of the term of this patent subsequent to Apr. 5, 1994, has been disclaimed.

[21] Appl. No.: 757,201

[22] Filed: Jan. 6, 1977

Related U.S. Application Data

[63] Continuation-in-part of Ser. No. 676,067, Apr. 12, 1976, Pat. No. 4,015,506.

[51] Int. Cl.[2] ..... F42B 37/00

[52] U.S. Cl. ..... 102/8; 89/1 A; 89/1 B; 256/6; 256/8

[58] Field of Search ..... 86/1 R; 102/8, 27 R; 89/1 A, 1 B; 228/107; 256/6, 8; 29/421 E

[56] References Cited

U.S. PATENT DOCUMENTS

| | | | |
|---|---|---|---|
| 2,812,710 | 11/1957 | Tyson | 102/8 |
| 3,698,280 | 10/1972 | Welsh | 86/1 R |
| 3,731,626 | 5/1973 | Grayson | 102/27 R |
| 3,763,529 | 10/1973 | Musgrave | 256/8 |
| 3,971,290 | 7/1976 | Blair | 89/1 B |
| 4,015,506 | 4/1977 | Musgrave | 89/1 A |

*Primary Examiner*—Edward A. Miller

[57] ABSTRACT

An explosive barrier wire for rapid emplacement with bare hands. The wire is assembled in a configuration wherein barbs or other hazardous elements are ineffective. After installation in an obstacle the barbs can be quickly deformed into a hazardous configuraton by explosive means.

10 Claims, 10 Drawing Figures

EXPLOSIVE BARRIER WIRE

This application is a continuation-in-part of my copending application Ser. No. 676,067, filed Apr. 12, 1976, now U.S. Pat. No. 4,015,506, and entitled Method of Forming Barrier Wire.

This invention relates to an explosive barrier wire for use in barricades or obstacles, such as those employed in military operations. The typical obstacle materials employed for such purposes require the use of tools or gloves during installation. Even when tools or gloves are used, installation is sometimes impracticable, as for example in darkness, in fog, or underwater by swimmers.

There are also situations requiring the installation of an obstacle in the absolute minimum of time. It is readily apparent that obstacle material which can be handled safely can be installed faster than that which is dangerous to handle.

In consideration of the above-recited circumstances the principal objet of this invention is to provide an explosive barrier wire which can remain relatively safe until installed in an obstacle, after which it can be rendered dangerous to handle or tranverse.

This and other objects of the present invention will become apparent from the following detailed description, taken in conjunction with the accompanying drawings, wherein.

Figure 1:
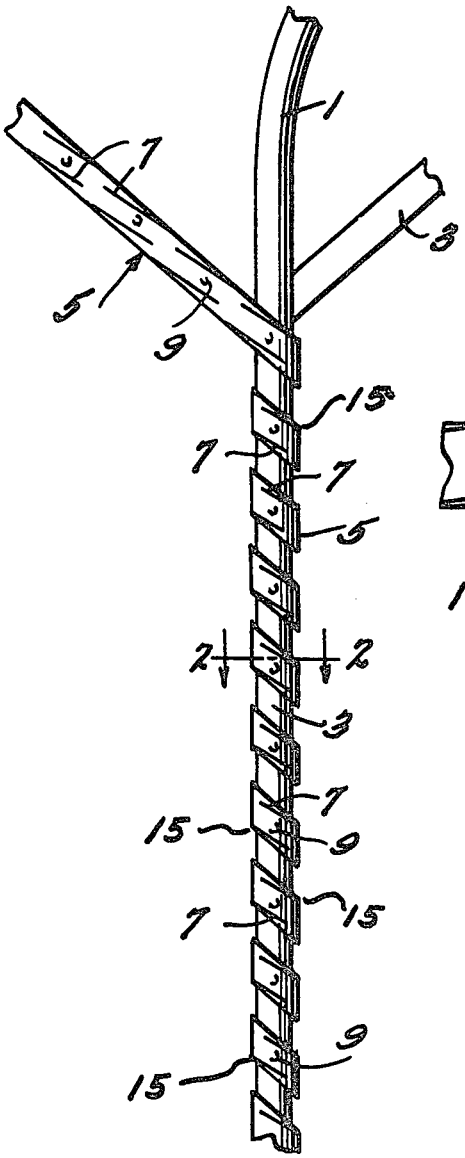
FIG. 1 shows how the component parts of an explosive barrier wire may be assembled.

Referring to the drawings FIG. 1 shows the components of a barrier wire including a flexible strand 1, which may be fabricated of any suitable material having the necessary characteristics. In addition to considerations of cost, weight and adaptability to production processes, important considerations are tensile strength and flexibility.

Wrapped around strand 1 in the form of a helix is strip 5 which may be of any suitable material. In addition to considerations of cost, weight, and adaptability to forming the helix, important considerations are strength and the capability to bend and take a set without fracturing. Strip 5 could be made of a metal, such as steel.

Figure 3:
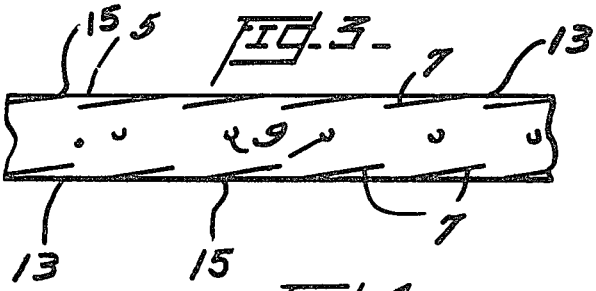
FIG. 3 shows a portion of one type of strip which can be used in forming a barrier wire.

Strip 5, which has generally a flat cross-section, is shown in some detail in FIG. 3 which illustrates the strip before being wrapped around the strand. Along the edge sections of the strip are slits 7 which intersect the edges 13 at acute angles. At each such intersection a point 15 is formed. The strip could also be grooved instead of slit, as this could accomplish the same result, as will become apparent later. Strip 5 may be resilient, or otherwise.

Strip 5 also has suitable indentations 9, of any convenient shape, protruding from it on the side which becomes the inside of the helix. Stated differently, indentations 9 protrude from that side of strip 5 which is close to strand 1 when the strip is wrapped around the strand. The purpose of the indentations is to assist in holding in position a tape 3, of explosive material, which is helically wrapped around strand 1, under strip 5. Strip 5 is wrapped around the strand with suitable clearance to hold explosive tape 3 in position when the barrier wire is coiled or uncoiled.

Figure 5:
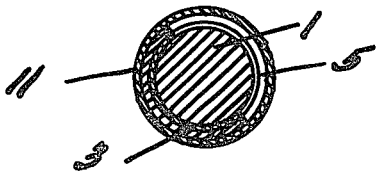
FIG. 5 is similar to FIG. 2, but shows an additional part as an alternate feature.

As shown in FIG. 5, protective covering of plastic or other suitable material may be positioned to protect the assembled barrier wire from the elements. It will also permit easy handling with the bare hands. Obviously, materials other than plastics may be used as the protective coating, and it is not intended to limit the disclosure to any certain material. In FIG. 5, the protective covering is indicated by numeral 11.

Figure 2:
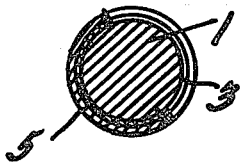
FIG. 2 is a cross section taken in the plane indicated by line 2—2 on FIG. 1.

Barrier wire incorporating the present invention can be readily installed without tools in various types of entanglements or obstacles. The installing is done with the wire in the condition shown in FIG. 1 and FIG. 2. (FIG. 5 is an alternate for FIG. 2.) At the time of installation the material can be handled with bare hands.

Figure 4:
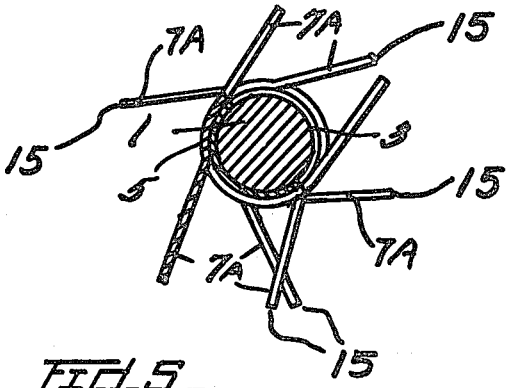
FIG. 4 is a cross section similar to FIG. 2, but after the barrier wire has been exploded.

In some situations, the user may decide that the obstacle is sufficient with the barrier wire installed as fabricated. If the situation demands the utmost degree of impassibility in the obstacle, the user may initiate the explosive tape, thus deforming barbs 7A away from strand 1 in the manner shown in FIG. 4. Barbs 7A are formed of material between slits 7 and edges 13 of strip 5. In deciding whether or not to fire the explosive, the user will be governed partly by the obvious consideration that after deforming the barbs explosively, it will no longer be feasible for him to move his obstacle. To conserve his barrier wire, if possible , he may install it in position but initiate the explosion only when an actual attempt is made to pass the obstacle. Devices for initiating explosives are well known and need not be described here.

Persons attempting to traverse the wire before the barbs have been deformed will be acutely aware that at any time the explosive may be fired, with disastrous results to the intruders.

When the barrier wire is fabricated with a protective coating, the barbs will puncture the coating when the tape is exploded.

Figure 6:
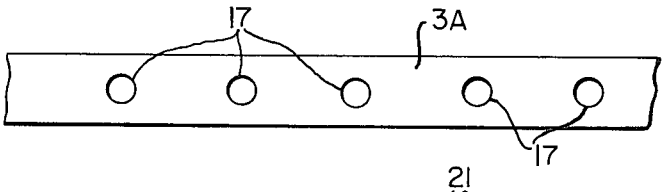
FIG. 6 is a view of one type of explosive tape which can be used in a barrier wire.

While it is necessary for the explosive tape to be continuous inside the helix formed by strip 5 the effects of the explosive are utilized mostly along the edges of the strip . To avoid the possibility that excessive explosive effects along its center line may rupture the strip, the central area of the explosive tape may be reduced as shown in FIG. 6. In that Figure an explosive tape 3A is shown with holes 17 formed therein.

Figure 7:
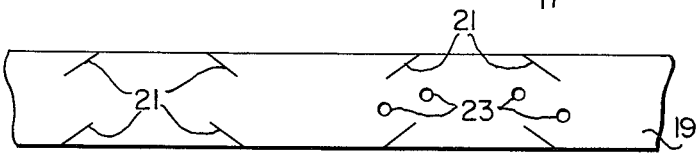
FIG. 7 shows another type of strip which can be used in a barrier wire.

To further relieve the explosive force on the strip, it can have holes formed at or near its longitudinal center line. Such a strip is shown in FIG. 7, where strip 19 is an alternate for strip 5 previously described. Formed in strip 19 are a plurality of holes 23. It is readily apparent that holes in the tape or in the strip will tend to reduce or relieve the explosive effect on the strip.

Figure 8:
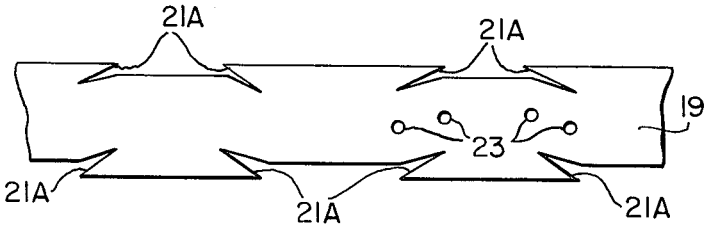
FIG. 8 shows, schematically, the same strip after the barrier wire has been exploded, the strip being shown flattened for comparison with FIG. 7.

It will also be noted that strip 19 in FIG. 7 has a plurality of slits 21 intersecting its edges. These slits are so positioned that any elongating force on the strip wil tend to open the slits and expose pointed portions 21A as shown in FIG. 8. Such an elongating force is provided by the explosion within the helix already described. However, FIG. 8 is schematic only, as the strip after the explosion will be in the form of a helix and considerably deformed. A detailed description of a process for displacing portions of a strip laterally by slitting and elongating the strip is disclosed in U.S. Pat. No. 3,763,529.

Figure 9:
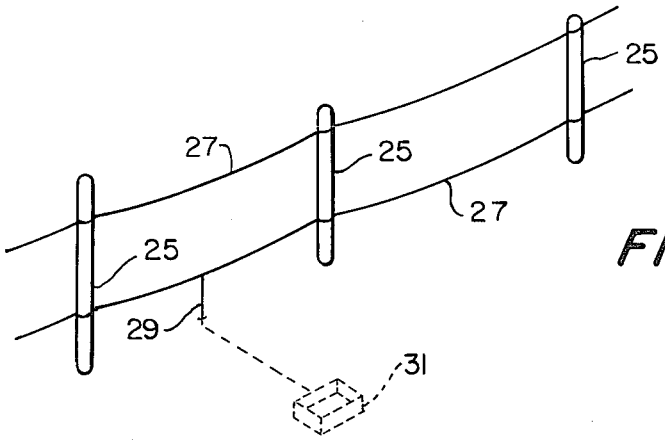
FIG. 9 shows a barrier wire installed in a simple obstacle.

FIG. 9 shows an elementary obstacle consisting of a series of posts 25 to which is affixed a barrier wire 27. Barrier wire 27 may be installed in the condition shown in FIGS. 1 and 2 and exploded after installation to deform the pointed portions.

The obstacle may also be prepared without exploding and arranged to explode when approached. An explosive relay 29 can be controlled by a sensor 31 which may be buried or otherwise concealed. When the sensor detects an intrudor it can fire the relay, which initiates the tape. Such relays and sensors are well known and need not be described here.

Figure 10:
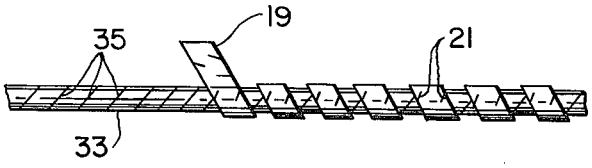
FIG. 10 shows an alternate arrangement of component parts to that shown in FIG. 1.

Another possible variation is the use of an explosive cord as the strand of the barrier wire. Such cords are commercial items made in various configurations with an explosive core. Such a cord 33 is shown in FIG. 10. It includes a reinforcing material 35, which might be wire or plastic, to give the cord sufficient tensile strength. Wrapped directly around the cord is strip 19 which, in this instance, is that type shown in FIG. 7. When the explosive cord is exploded, pointed portions defined by slits 21 and the edges of the strip are deformed outwardly to form the barrier wire. Some elongating effect may act on the strip also, tending to open the slits and displace the points as previously described.

There is thus described a simple barrier wire which can be transported and installed without injuring the user. It is desired to point out that the disclosure is exemplary, and that variations of geometry, materials and of other features can be incorporated into this invention. For this reason, the disclosure should not be considered limiting.

It is not intended to limit the invention to use in any particular type of obstacle. It can be used in various types of obstacles, including those intended to entangle the wheels or tracks of moving vehicles.

It is also desired to point out that the present invention permits the use of barbs of sizes and shapes which would be impractical in typical obstacle materials previously known. This is because very long or extremely jagged barbs are subject to severe tangling when obstacle material is coiled for transportation. The present invention avoids this limitation and allows the use of barbs having maximum effectiveness.

What I claim is:

1. An explosive barrier wire comprising: a flexible strand; a strip wrapped around said strand, said strip including portions adapted for deformation outwardly whereby said barrier wire will have a hazardous configuration; and explosive means interposed between said strand and said strip; whereby initiation of said explosive means can deform said portions outwardly.

2. A barrier wire as set forth in claim 1 wherein said strip is wrapped helically around said strand.

3. A barrier wire as set forth in claim 1 wherein said explosive means comprises an explosive tape.

4. A barrier wire as set forth in claim 3 wherein said tape has holes formed therein.

5. A barrier wire as set forth in claim 1 wherein said strip has holes formed therein.

6. A barrier wire as set forth in claim 1 wherein said strip has grooves intersecting each edge thereof.

7. A barrier wire as set forth in claim 6 wherein said grooves intersect each said edge at an acute angle.

8. A barrier wire as set forth in claim 6 wherein said grooves do not extend to the longitudinal center line of said strip.

9. A barrier wire as set forth in claim 1 further provided with external cover means positionally adapted to be ruptured by said portions when said portions are deformed outwardly.

10. An explosive barrier wire comprising: an explosive cord; and a strip wrapped around said cord, said strip including portions adapted for deformation outwardly whereby said barrier wire will have a hazardous configuration; whereby initiation of said cord can deform said portions outwardly.

* * * * *